US008525442B2

(12) United States Patent
Zimmermann et al.

(10) Patent No.: US 8,525,442 B2
(45) Date of Patent: Sep. 3, 2013

(54) OPERATING CIRCUIT FOR LEDS

(75) Inventors: Michael Zimmermann, Heiligkreuz (CH); Eduardo Pereira, Siebnen (CH)

(73) Assignee: Tridonic AG, Ennenda (CH)

( * ) Notice: Subject to any disclaimer, the term of this patent is extended or adjusted under 35 U.S.C. 154(b) by 139 days.

(21) Appl. No.: 13/125,022

(22) PCT Filed: Oct. 16, 2009

(86) PCT No.: PCT/EP2009/007455

§ 371 (c)(1),
(2), (4) Date: Apr. 19, 2011

(87) PCT Pub. No.: WO2010/046065

PCT Pub. Date: Apr. 29, 2010

(65) Prior Publication Data

US 2011/0199023 A1 Aug. 18, 2011

(30) Foreign Application Priority Data

Oct. 20, 2008 (AT) ..... GM599/2008

(51) Int. Cl.
*H05B 41/36* (2006.01)

(52) U.S. Cl.
USPC ..... 315/307; 315/308; 315/311; 315/209 R

(58) Field of Classification Search
USPC ..... 315/209 R, 119, 121, 122, 125, 127, 315/185 R, 186, 192, 193, 210, 225, 226, 315/291, 297, 299, 302, 306, 307, 308, 310, 315/312, 313, 360, 362
See application file for complete search history.

(56) References Cited

U.S. PATENT DOCUMENTS

2009/0096413 A1* 4/2009 Partovi et al. ..... 320/108
2009/0273292 A1 11/2009 Zimmermann

FOREIGN PATENT DOCUMENTS

| | | | |
|---|---|---|---|
| DE | 102006034371 | A1 | 10/2007 |
| EP | 0948241 | A2 | 10/1999 |
| EP | 1033903 | A2 | 9/2000 |
| WO | 2004006629 | A2 | 1/2004 |
| WO | 2004057921 | A1 | 7/2004 |
| WO | 2007049198 | A1 | 5/2007 |
| WO | 2008068682 | A1 | 6/2008 |

* cited by examiner

*Primary Examiner* — Douglas W Owens
*Assistant Examiner* — Jianzi Chen
(74) *Attorney, Agent, or Firm* — Volpe and Koenig, P.C.

(57) ABSTRACT

An operating circuit is provided for an LED, which receives a voltage, and which supplies a voltage for the LED via a coil, having a first switch clocked by a control/regulating unit. Power is stored temporarily in the coil when the first switch is activated so that the power is discharged via a diode and via the LED when the first switch is turned off. A capacitor is arranged in parallel to the LED and maintains current through the LED during the demagnetization of the coil. A first switch generates a first sensor signal dependent on the current flowing through the first switch, and/or a second sensor unit, which detects whether demagnetization of the coil unit has occurred and generates a sensor signal. The signals are fed to the control/regulating unit and processed. The control/regulating unit reactivates the first switch when the coil is demagnetized and/or the diode is blocking.

14 Claims, 4 Drawing Sheets

OPERATING CIRCUIT FOR LEDS

Figure 1A:
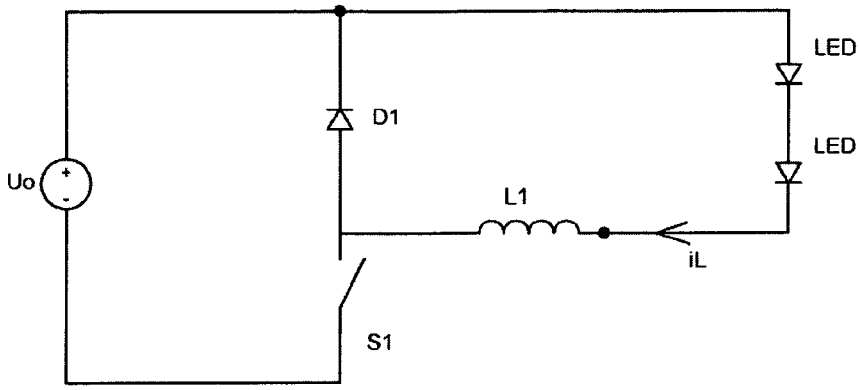

The invention relates to an operating circuit provided with light diodes according to the preamble of the patent claim 1, and to a method for operating light diodes according to the preamble of patent claim 14.

TECHNICAL FIELD

Semiconductor light sources, such as for example light diodes, have been increasingly attracting attention in recent years in particular with regard to their application for illumination. One of the reasons for this is the fact that important technical innovations and major advances have been achieved both with respect to brightness, but also with respect to light efficiency (the light output per Watt) of these light sources. Las but not least, it also became possible to develop light diodes which thanks to their relatively long lifespan represent an attractive alternative to conventional light sources such as glow (incandescent) lamps or gas discharge lamps.

PRIOR ART

Semiconductor light sources are well known from prior art. Hereinafter, they will be abbreviated as LEDs (light emitting diodes). This term will include in the following text both light diodes that are made from inorganic materials, as well light diodes that are made from organic materials. It is known that the light irradiation from LEDs is correlated with the current flowing through the LEDs.

In order to control brightness, LEDs are essentially operated in a mode in which the flow of the current through the LED is regulated.

A switch controller (step-down or buck controller) is preferably used in practice in order to control an arrangement containing one or more LED. A similar switch controller is known for example for DE 10 2006 034 371 A1. In this case, a control unit controls a switch which is clocked at a high frequency (for example a power transistor). In the activated stat of the switch, the current flows through the LED arrangement and a coil which is charged in this manner. The energy of the coil, which is stored with intermediate storage, is discharged through the LEDs (recovery phase). The current displays a zigzag path through the LEDs: when the switch is in the activated state, the LED current displays a climbing edge, when the switch is turned off, a trailing edge is displayed. The mean value of the time interval of the LED current represents the effective current flowing through the LED arrangement as a measurement of the brightness of the LEDs. The mean effective current can thus be controlled with a suitable clocking of the power switch.

The function of the operating device is in this case to adjust the current flowing through the LED to a desired mean current flow, and to maintain the temporal fluctuations in the range of the variations of the current, which will depend on the high frequency that is used to turn the switch on and off (typically in the range above 10 kHz), at a level that is as low as possible.

A wide range of variations of the current (waviness or ripples) exerts a particularly detrimental influence on the LEDs because the spectrum of the emitted light can be changed when the amplitude of the current is changed.

In order to maintain the spectrum of the emitted light as constant as possible, it is known that instead of varying the amplitude of the current to control the brightness of LEDs, a so called PWM (pulse width modulation) method can be used. The LEDs are in this case maintained supplied using the lower frequency pulse packets of the operating device (typically with a frequency in the range from 100-1,000 Hz) at a constant current amplitude (on a time average). The current in one pulse packet is superimposed on the high frequency ripple mentioned above. The brightness of the LEDs can be then controlled by the frequency of the pulse packet, the LEDs can be for example dimmed so that the time interval between the pulse packets is increased.

A practical requirement on the operating device is that it should be possible to use the device universally and with as much flexibility as possible, for example, independently of how many LEDs representing a load are in fact connected and operated. Moreover, it should be possible to change the load during the operation, for example when one LED fails. According to conventional technology, the LEDs are operated in a so called "continuous conduction mode", or with continuous operations. This method will be explained in greater detail with reference to FIG. 1*a* and FIG. 1*b* (prior art).

In the example indicated in FIG. 1*a*, a step-down converter (buck converter) serves as a basic circuit for the operation of one LED (or several LEDs connected in series), which is equipped with a first switch S1. Direct current voltage or rectified alternating current voltage U0 is supplied to the operating circuit.

Figure 1B:
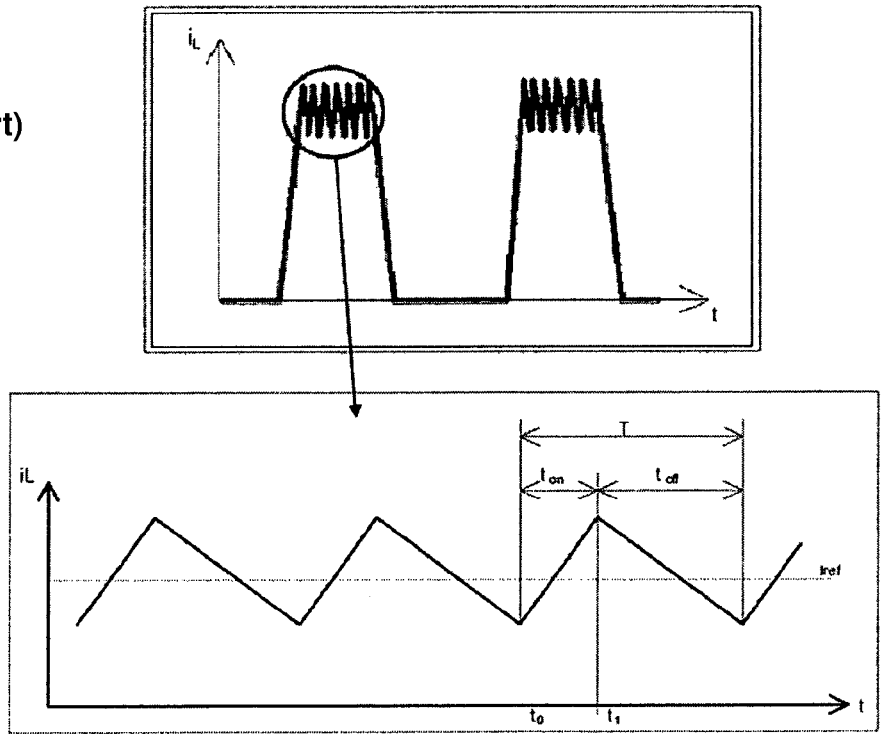
Fig. 1b (Prior Art)

When the first circuit S1 is turned on, energy is built up in the coil L1 (during the time period t_on), which is then discharged in the turned off state of the first switch S1 (time period t_off) through at least one LED. The resulting current profile with respect to time is illustrated in FIG. 1*b* (conventional technology). Two pulse packets PWM are indicated in this case. The current profile within one pulse packet is shown at a magnified scale. In order to maintain a constant color, the amplitude of the ripple within the pulse packet should be as small as possible. This can be achieved with a suitable selection of the point in time t0 when the device is turned on, and the point in time t1, which is the point when the device is turned off. These points in time can be selected for example so that the first switch S1 is activated when the current is below a certain minimum reference value, and so that the switch is turned off when the maximum reference value is exceeded. This method has several disadvantages: For one, a quick sequence of activating and deactivating occurrences is required to achieve a ripple that is as small as possible. This is because the increase (positive or negative edge) of the current cannot be controlled by the operating device, which should thus be considered as a given, since it is determined, among other things, by the inductance of the coil L1 and by the increased output of the LEDs.

In order to reduce the waviness (ripples), more switching occurrences would have to take place within a certain time segment, which would naturally lead to switching losses. Moreover, these switching losses are particularly high in the continuous conduction mode.

Although an actual semiconductor switch is switched on very quickly, it cannot be switched on with infinite quickness. The amount of energy which is dissipated during the switching process will be greater when the switching process takes longer, and also when the output, which is applied during the switching process to the switch, is higher. In non-continuous operations, the switching losses are particularly high because the switching processes are realized when high currents are applied.

DESCRIPTION OF THE INVENTION

The object of the present invention to provide an operating circuit which is an improvement of prior art, for at least one LED, and a method for enabling the operation of at least one LED, which makes it possible to maintain in a simple manner a constant current and thus also the LED performance.

This object is achieved in accordance with the invention based on the independent claims of the invention. The dependent claims represent a further development of the central concept of the invention in a particularly advantageous manner.

According to a first aspect of the invention, the operating circuit for at least one LED supplies direct current voltage or rectified alternating current voltage. A supply voltage for at least one LED is provided by means of one coil and a first switch which is clocked by a control/regulation unit, whereby when the first switch is turned on, power is temporarily stored in the coil and it is discharged through a diode and through at least one LED when the first switch is turned off.

The operating circuit is equipped with a capacitor, which is arranged in parallel to at least one LED and which maintains the current during the phase of the demagnetization of the coil L1 through the LED, so that the current through the LEDs is smoothed.

In accordance with the circuit according to the invention, the control/regulation unit selects the point in time for turning the first circuit off in such a way that as little switching losses as possible will occur, and despite the current flow provided through the at least one LED, a ripple that is as small as possible is exhibited.

In a preferred embodiment of the invention, the operating unit is equipped with a first sensor unit which generates a sensor signal with the first switch depending on the current flow, and/or a with second sensor unit which detects the demagnetization of the coil and generates a sensor signal. The sensor signals are supplied to and are processed by the control/regulation unit.

In accordance with the invention, the control unit uses a signal of the first sensor unit, or a signal of the second sensor unit, or a combination of both signals in order to determine the point in time for turning on and/off the first switch.

In accordance with the invention, the control/regulation unit turns the first switch off when the current flowing through the first switch exceeds a maximum reference value, and then it is turned on again at the point in time when the coil is demagnetized and/or the diode is blocking. In a preferred embodiment of the invention, the first sensor unit is a measurement resistor (shunt). In another preferred embodiment of the invention, the second sensor unit is a secondary winding which is inductively coupled with the coil, or a Hall sensor. In another embodiment, the second sensor unit senses that the demagnetization of the coil has been reached as it monitors the voltage above the first switch by means of a (resistive) voltage distributor.

Other preferred embodiments and further developments of the invention are the subject of further dependent claims.

The present invention will now be explained in detail based on preferred embodiments with reference to the attached drawings.

FIG. 1*a* shows a circuit arrangement according to the known prior art.

Figure 2A:
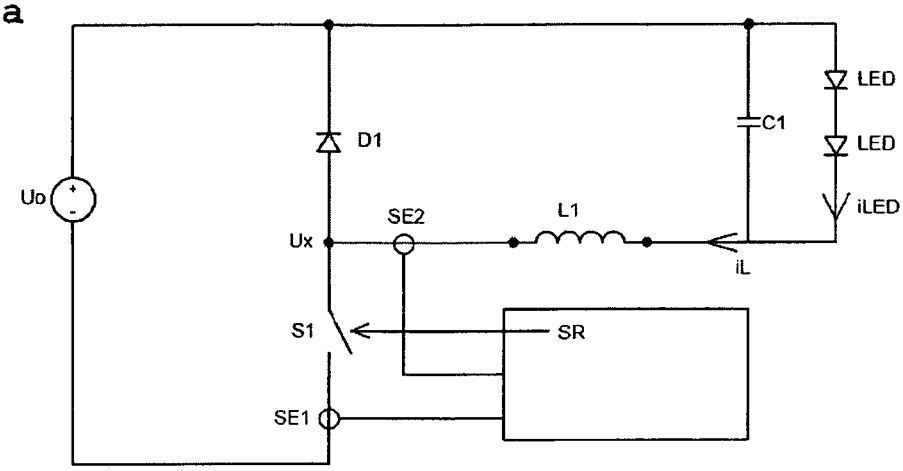
Figure 2B:
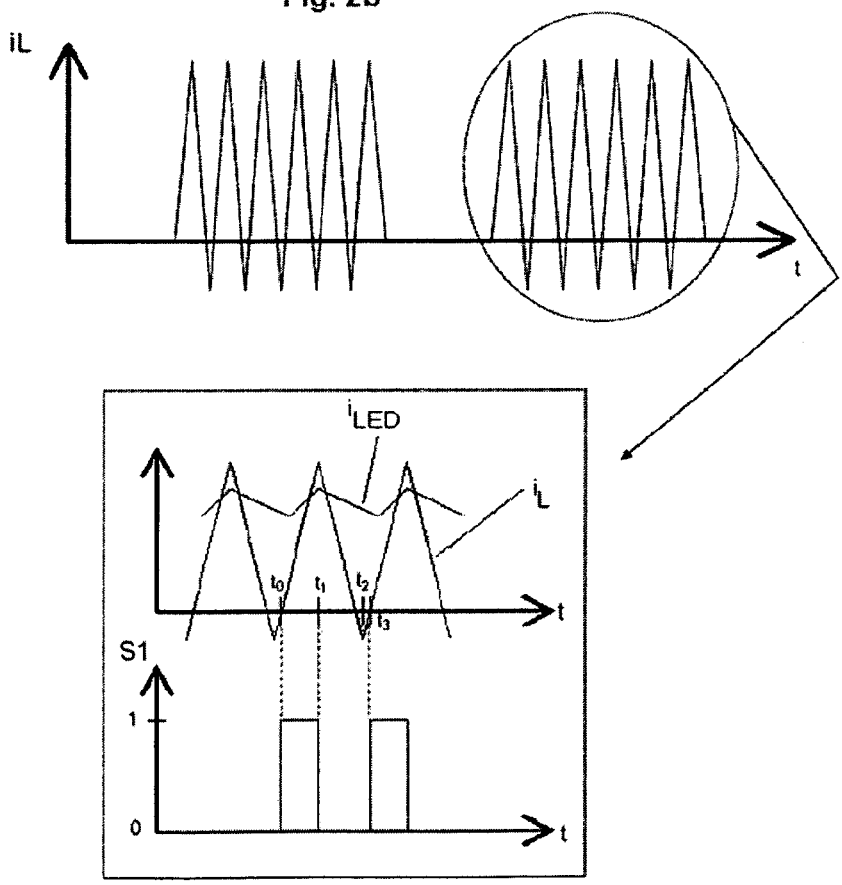
Figure 3:
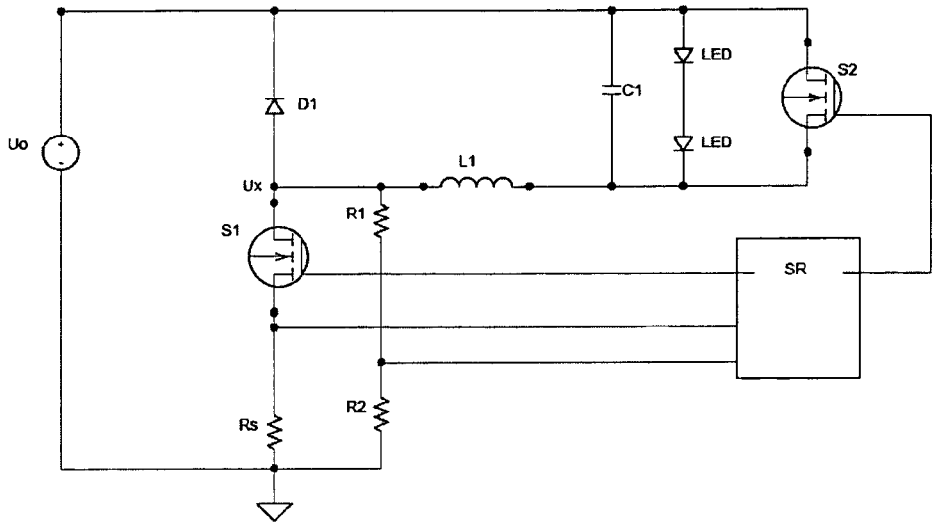
Figure 4:
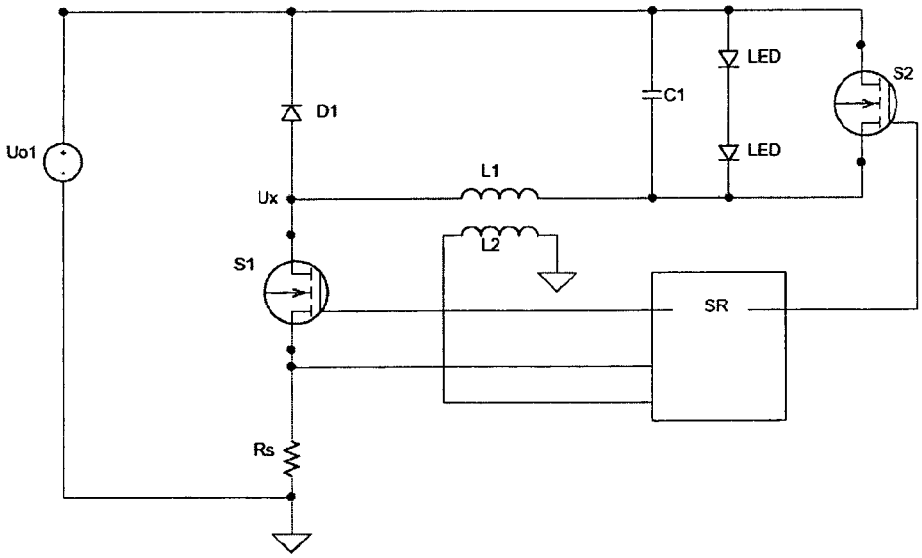
Figure 5:
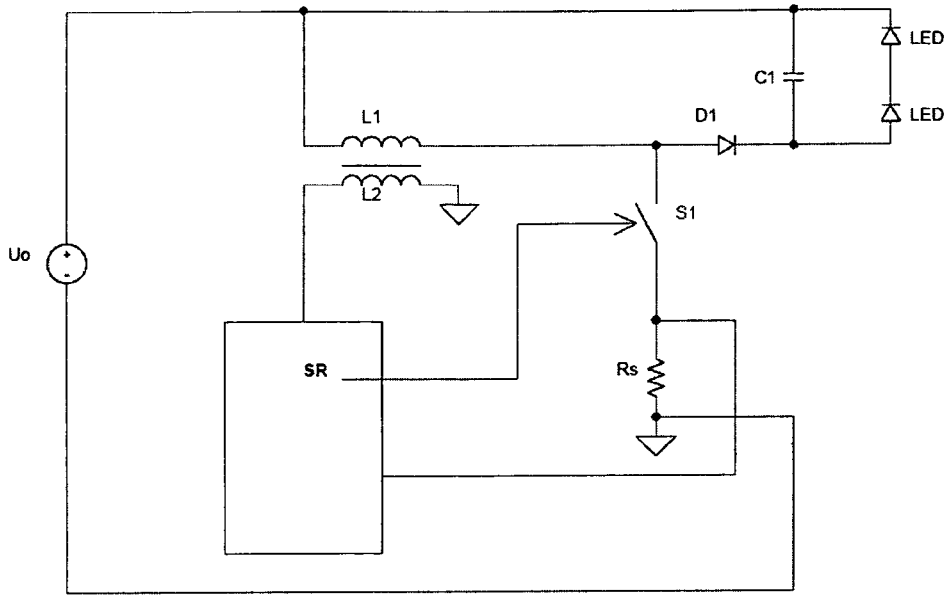
Figure 6:
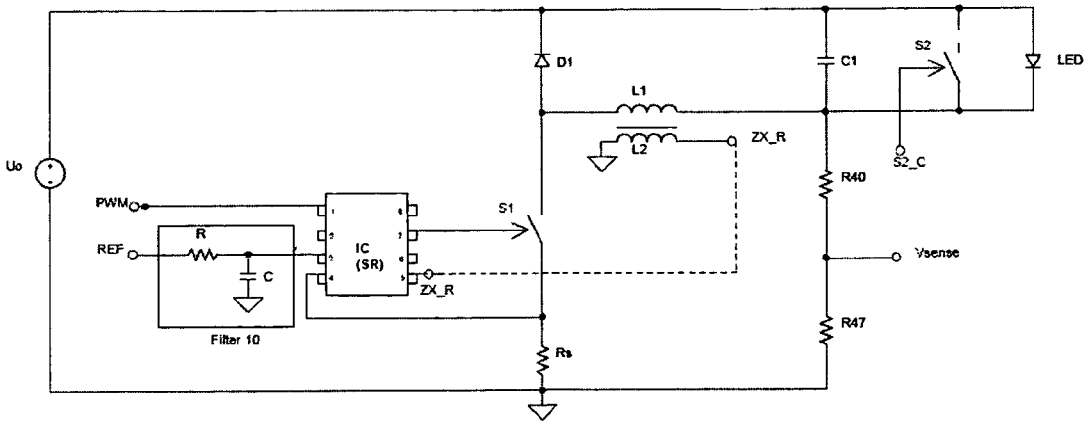

FIG. 1*b* shows a diagram indicating the progress in time of the LED current in the circuit arrangement of FIG. 1*a* (prior art), FIG. 2*a* shows a first example of an operating circuit (Buck) for LEDs according to the invention, FIG. 2*b* shows a diagram, which illustrates current developments depending on time and control signals of the circuit arrangement shown in FIG. 2*a*, FIG. 3 and FIG. 4 show particular embodiments of the invention, FIG. 5 shows a modification of the circuit of FIG. 2*a* (Buck Boost), FIG. 6 shows another particular embodiment of the invention.

FIG. 1*a* and FIG. 1*b* show prior art.

The circuit arrangement shown in FIG. 2*a* is used to operate at least one LED (or several LEDs, which are connected in series and/or in parallel). In the example shown in the drawing, two LEDs are used connected in series, but it is naturally also possible, for example, to use one or multiple LEDs. The LED or the LEDs that are connected in series or in parallel will be hereinafter referred to as LED segment. One advantage of the present invention is that the operating circuit can be adjusted with a great deal of flexibility depending on the type and number of the LEDs that are connected in series. The direct current voltage supplied to the circuit can naturally also be a rectified alternating current voltage. The LEDs are connected in series with a coil L1 and with a first switch S1.

In addition, the circuit arrangement is equipped with a diode D1 (the diode D1 is connected to the LEDs and to the coil L1 in parallel), and to a capacitor C1 which is connected to the LEDs in parallel. In the activated state of the first switch S1, the current flows through the LEDs and through the coil L1 which will become magnetized as a result.

In the turned off state of the first switch S1, the energy stored in the magnetic field of the coil is discharged in the form of a current flowing through the diode D1 and the LEDs. In parallel with these occurrences, the capacitor C1 is charged at the beginning of the activation of the first switch S1.

During the switched off phase of the first switch S1 (recovery phase), the capacitor C1 is discharged and it contributes to the current flowing through the LED segment. This can lead to a smoothing of the current through the LEDs with a suitable dimensioning of the capacitor C1.

For the first switch S1, a field effect transistor is preferably used, but a bipolar transistor can be also employed. The first switch S1 is connected with a high frequency, typically in a frequency range above 10 kHz.

One advantage of the invention is that the first switch S1 can be protected during operations because, as will be explained later, it is preferably activated when the power applied to it equals almost zero. In contrast to that, since switching events according to conventional technology occur at a high power, an expensive structural element must be used for the first switch S1 with a very short duty cycle in order to maintain the switching losses within a tolerable range.

One advantage of the switch according to the invention is that for the first switch S1 and for the diode D1 a relatively much less expensive structural element can also be used with a relatively somewhat longer switching duration or longer depletion time.

The circuit of FIG. 2*a* is further also provided with a control and/or regulation unit SR which provides the clock of the first switch S1 used to control the LED power.

The control/regulation unit SR uses signals from a first sensor unit SE1 and/or signals from a second sensor unit SE 2 as input size signals for determination of the exact point in time for turning the first switch S1 on and off.

The first sensor unit SE1 is arranged in series with the first switch S1 and detects the current flowing through the first switch S1. This is used to monitor the current flowing through the first switch S1. If the current flowing through the first switch S1 exceeds a certain predetermined maximum reference value, the first switch S1 is turned off. In an advantageous embodiment of the invention, the first sensor unit SE1 can be for instance a measurement resistor (shunt or current resistor).

In order to monitor the current flow, the voltage drop can be measured at the measurement resistor (shunt), for example by means of a comparator which performs a comparison to a reference value.

If the voltage drop at the measurement resistor (shunt) exceeds a predetermined value, the first switch S1 is turned off.

The second unit SE2 is arranged within the current branch through which the current flows during the recovery phase, preferably in the vicinity of or on the coil L1. By means of the second sensor unit SE2, the control unit/regulation unit SR can determine a suitable point in time for turning on the first switch S1.

In accordance with the invention, the first switch S1 is preferably activated when the current flowing through the coil L1 is for the first time at zero or at least very low, which is to say preferably during the time interval when the diode D1 is blocking at the end of the recovery phase. According to the invention, as little current as possible is applied at the switch S1 at the point in time when the switch S1 is turned on. An almost loss-free switch is made possible with the detection of the zero crossing of the current at the coil L1. According to the invention, the current is indicated through the LEDs with only a small brightness and the fluctuations are not strong. This is due to the smoothing effect of the capacitor C1 which is connected in parallel to the LEDs. The capacitor C1 takes over the supplying of the LED during the phase of a low coil current.

The individual current characteristics and the optimal point in time for turning on the first switch S11 will be further explained based on the diagram shown in FIG. 2*b*.

Similarly to the diagram shown in FIG. 1*b*, the figure shows the temporal course of the current i_L across two pulse packets.

The enlarged representation shows the current characteristics within a PWM pulse packet: namely the course in time of the current i_L in the coil L1, the course in time of the current i_LED in the LEDs, and the course in time of the state of the first switch S1 (the first switch S1 is turned off in state 0, and the first switch S1 is closed in state 1; the signals for the state of the switch S1 correspond to the control signal (namely at the gate) of the switch S1. At the point in time t_0, the first switch S1 is closed and a current is starting to flow through the LED and through the coil L1. The current i_L displays an increase according to an exponential function, whereby a more or less linear increase of the current i_L can be recognized in the region which is of interest here. i_LED differs from i_L in that one part of the current i_L contributes to the charging of the capacitor C1. A consequence of the opening of the first switch S1 at the point in time t_1 (for example when a desired maximum reference value has been reached) is that energy that is stored in the magnetic field of the coil is discharged through the diode D1 and the LEDs or the capacitor C1. The current i_L flows then in the same direction, but it is continuously decreased and it can even reach a negative value. A negative current (which means a current in the opposite direction) will be present as long as the depletion of the charging carrier, which was previously enriched in the conducting polarized diode, is performed from the blocking layer of the diode D1.

The current i_LED will be increased only slightly and it will be maintained because the capacitor C1 has a smoothing effect. At the point in time t_2, the diode will be blocking. The current i_L is decreased (and will then be negative), and continues toward zero. In this phase, parasitic capacities on the diode D1 and other parasitic capacities are transferred to the remaining circuit.

The voltage at the node Ux above the first switch S1 drops to a low value (as a result of the blocking by the diode D1). An advantageous point in time t_3 for reactivating the first switch S1 will then be encountered when the current i_L reaches the zero crossing i_L, or at least when it is in the vicinity of the zero crossing. At this point in time, the coil L1 is not magnetized or hardly magnetized at all. The first switch S1 can be turned on at this point with very little loss because hardly any current is flowing through the coil L1.

However, it can be then reactivated again already at the point in time t_2, or shortly prior to this point, because the current flowing through the coil L1 is during this time period very low.

A second sensor unit SE1 is used for detection of an advantageous point in time for turning on the first switch S1. In a first embodiment, the current i_L can be detected for example through the coil L1. However, this will necessitate relatively expensive circuits. The current i_L flowing through the coil L1 can be detected for example by means of a Hall sensor. Additionally or as an alternative, further/other sizes can be utilized which are suitable for detection of an advantageous point in time for activation.

In another advantageous embodiment, for example the magnetization state of the coil L1 can be detected. The second sensor unit SE2 can be for example a secondary winding L2 on the coil L1, which detects the voltage on the coil L1. The monitoring of the temporal progress of the voltage on the coil L1, (in particular of the "surge" shortly after the closing of the diode D1 after the point in time t_2), makes it possible to obtain a determination of an advantageous point in time for the reactivation of the first switch S1. In a simple embodiment variant, a comparator would serve to detect that demagnetization (and thus the zero crossing) was reached based on a value above or below the threshold value.

Instead of or complementary to monitoring of the voltage on the coil L1, the voltage can also be monitored at the node Ux above the first switch S1. The voltage at the node Ux falls significantly from a high value to a low value when the diode is closed. The signal to reactivating the first switch S1 can therefore be triggered when the voltage Ux is below a certain threshold value. The control/regulation unit SR turns the first switch S1 on again at the point in time when the coil L1 is demagnetized and/or the diode D1 is blocking. The second sensor unit S2 can in this cases comprise a secondary coil L2 which is inductively coupled to the coil L1, or a voltage distributor (R1, R2) at the node Ux.

The control/regulation unit SR uses the information obtained from the first sensor unit SE1 and/or the second sensor unit SE2 in order to determine the point in time for turning the first switch S1 on and off. The regulation of the (time-averaged) LED performance through the control/regulation unit SR can be realized for example in the form of PWM signals. The frequency of the PWM signals is typically in the range of 100-1,000 Hz.

FIG. 3 and FIG. 4 show particular embodiments of the invention.

FIG. 3 illustrates a particular embodiment of the circuit arrangement explained above (a step-down or buck converter). The advantageous point in time for deactivation is in this case obtained by detecting the voltage at the node Ux above the first switch S1. This is performed with the resistive distributors R1 and R2. The node Ux is located between the coil L1, the diode D1 and the switch S1.

A capacitive voltage distributor or a combined voltage distributor from resistance and capacitance can be used, for example, as a voltage distributor.

The measurement resistor (shunt) Rs serves to detect the current flowing through the first switch S1. The monitoring of the temporal progress of the voltage at the node Ux (in particular of the "drop" shortly after the blocking of the diode D1 in the vicinity of the point in time t_2) enables a determination of the advantageous point in time for reactivating the first switch S1.

Instead of or complementary to voltage monitoring, the voltage can be monitored on the coil L1 for example at the node Ux above the first switch S1. The voltage at the node falls significantly when the diode is blocking, from a high value to a low value. The signal to turn the first switch on again can therefore be triggered when the voltage of Ux is below a certain threshold.

In the switching arrangement of FIG. 3, a second switch S2 is additionally arranged also parallel to the capacitor C1. The second switch S2 can be controlled selectively/independently, and it can be for example a transistor (a MOSFET or a bipolar transistor). When the second switch S2 is closed, the discharging operation of the capacitor S2 is accelerated. The purpose of accelerated discharging of the capacitor C1 is for the current flowing through the LED to attain the zero crossing point as soon as possible. This is desirable for example at the end of a PWM packet where the current flowing through the LED should fall off as quickly as possible, i.e. the falling edge of the current progress should be as abrupt as possible (to achieve constant colors). Preferably, the second switch S2 can be activated and controlled at a low dimming level so that the PWM packets are very short, and it is important that the current flow through the LED at the end of a pulse packet quickly approach zero. For example, an even lower dimming level can be achieved with a suitable control of the second switch S2.

A further function of this second switch S2 is that it bridges over in the activated state the LEDs. This is required for example when the LEDs are to be turned off, i.e. when they should not be emitting any light, but the U0 supply is still applied. Without the bridging over through the second switch S2, a current (albeit a small one) would flow through the LEDs and the resistors R1 and R2 and the LED would be (weakly) lit up.

It should be mentioned that the arrangement provided with a second switch S2 parallel to the LEDs and to the capacitor C1 in order to accelerate the discharging of the capacitor C1, or to bridge the LEDs, is not limited only to special embodiments of the circuit arrangement of FIG. 3, since it can be employed in all embodiments of the invention.

FIG. 4 shows a modification of the circuit shown in FIG. 3, wherein the monitoring of the voltage is performed on the coil L1. The voltage on the coil L1 can be detected for example with a secondary winding L2 which is coupled to the coil L1 (or an additional coil L2 which is inductively coupled to the coil L1). A secondary winding L2 is used in this case in order to detect an advantageous point in time for the first switch S1. The monitoring of the temporal progress of the voltage on the coil L1, (in particular the "drop" in the vicinity of the closing of the diode D1 after the point in time t_2), makes it possible to obtain a determination of an advantageous reactivation point for the first switch S1. This monitoring can, as was already mentioned, be performed also with a secondary coil L2.

The determination of the point in time for the zero crossing or for the demagnetization can also be achieved, as was already mentioned, by monitoring of the threshold values (based on monitoring of values below and above a threshold value, so that when the monitoring is performed by means of a secondary winding L2, the polarity of the voltage depends on the winding direction of the secondary winding L2 relative to the coil L1).

It should be mentioned that the method for detecting an advantageous point in time for turning on the first switch S1 can be naturally also applied to a different switching topologies, for example for a so called flyback converter, or buck boost converter or forward converter. FIG. 5 shows a modification of the circuit of FIG. 2*a*, in that the arrangement of the choke L1, of the diode D1 and the orientation of the LED segment are modified (a flyback converter or a buck boost converter is formed).

A further development of the invention is illustrated in FIG. 6. The identification of the demagnetization of the coil L1 can be carried out by means of monitoring of the voltage at the coil L2, for example with a standard control circuit IC which is readily available. This control circuit IC (integrated switching circuit), which corresponds to or contains the control/regulation unit SR according to FIG. 2 through 5, is equipped with an input for identifying that demagnetization of one coil was reached based on the monitoring of the voltage on one secondary winding provided on one of the coils. Further, the control circuit IC is equipped with an output for controlling one switch and with further monitoring inputs.

A first input of these monitoring inputs can be used for the input of a reference value such as for example reference voltage.

A second monitoring input can be used for monitoring whether a maximum voltage was reached, or also whether a maximum voltage is used based on measurement of voltage. A third monitoring input can be used to monitor another voltage, or also for the deactivation or activation of the control circuit IC, or to control the switches which are controlled by the control circuit IC.

As shown in FIG. 6, the control circuit monitors the current with a first switch S1 during the phase when the first switch S1 is turned on through the measurement resistors (shunt) Rs and through the input 4 at the control circuit IC. As long as the voltage, which is detected through measurement resistors (shunt) Rs, is detected, a certain maximum value is reached and the first switch S1 is opened. The default value for a voltage level required for the opening of the first switch S1 can be adjusted according to the default reference value at the input 3 of the control circuit IC. For example, a reference voltage can be input from a microcontroller, which inputs the maximum level through the measurement resistor (shunt) Rs of allowable voltage and thus also the maximum allowable current through the first switch S1.

By way of an example, the microcomputer can generate a PWM signal which is smoothed by a filter 10 (for example an RC element), and applied in this manner as a direct current voltage signal with a certain amplitude at the input 3 of the control circuit IC. The amplitude of the signal at the input 3 of the control circuit IC can be adjusted by changing the detecting relationships of the PWM signal of the microcontroller.

The control circuit IC can detect whether demagnetization of the coil L1 has been reached via the input 5 based on the monitoring of the voltage on one of the secondary winding L2. This recognition can be used as a reactivation signal. As soon as the demagnetization of the coil L1 has been recognized by the control circuit IC, the control circuit IC can switch on the first switch S1 through the control applied via the output 7.

The control circuit IC can perform activation and/or also deactivation by applying a voltage at the input 1. This voltage for activation at the input 1 can be also alternated between a high and a low level, in which the control circuit IC is activated at the high level and at least the control over the first switch S1 is performed at the low level. This control over the input 1 can be carried out by a microcontroller. For example, a low frequency activation and deactivation of the control circuit IC can be achieved in this manner and thus also the control over the first switch S1, as well as a low-frequency control over the operating circuit which can be used to dim the LEDs.

Moreover, it is also possible to set also another reference voltage for the control circuit IC through the amplitude of the signal that is applied at this input. This voltage can for example influence also the level of the maximum allowable current flowing through the switch, but also the allowable duration of the time period when the switch S1 is turned on. The control circuit IC and/or the control circuit IC combined with the microcontroller can together form the control unit SR.

The duration of the activation period of the first switch S1 can be also dependent on another voltage measurement within the operating circuit. For example, a Vsense voltage can be also supplied to the control circuit IC. It is thus also possible to perform measurements of the voltage at the node between the coil L1 and the LED through a voltage distributor R40/R47. This voltage measurement Vsense can be supplied either to another input of the control circuit IC as an additional variable which is added to an already occupied input of the control circuit IC, but it can be also furnished to an input of the microcontroller.

Therefore, a system can be built in this manner which on the one hand enables a simple control of the dimming of the LED through a low-frequency PWM, and which on the other hand also makes it possible to achieve high-frequency operation of the operating device with as low losses as possible, in combination with as constant a current supplied through the LED as possible.

It is also possible to specify through a microcontroller both the frequency and the duty cycle of a PWM signal in order to dim the LEDs, and also the level of the maximum allowable current can be preset through the first switch S1. The microcontroller can control with a signal which is supplied to the input 1 of the control circuit IC the dimming of the LED using a low frequency PWM. In addition, the microcontroller can also specify through a signal which is supplied to the input 3 of the control circuit IC the level of the maximum current through the first switch S1, but also the required time period during which the first switch S1 is turned on.

The operating circuit can further also contain another switch S2 which is arranged in such a way that this second switch S2 can bridge the LEDs.

The second switch S2 can be further arranged in such a way that it can take over from the LEDs, or interrupt the current with an existing high resistive voltage measurement path, or a similar existing highly resistive switching arrangement.

The LEDs can be bridged and thus deactivated with a parallel switch of the second switch S2 to the LEDs. This method can be used to adjust the brightness (dimming) of the LEDs. One possible variant would be when the dimming is realized via a second switch S2, while the current is adjusted and controlled only by controlling the first switch S1.

It is also possible to combine the control over both switches S1 and S2 to achieve an optimized dimming control. For example, the second switch S2 can be additionally used only for dimming to a low dimming level. The operating switch is due to the existing topology and the control circuit is designed in such a way that the output voltage of the operating circuit (i.e. the voltage for the LEDs) is limited to a maximum allowable value. If the LEDs are bridged when the second switch S2 is turned on, the control circuit limits the output voltage in such a way that no excessive current can flow which could result in possible interference. This control of the second switch S2 can be used for example only for dimming on a low dimming level.

When the step down converter (buck converter) design is operated during the power source supplying operations (in a so called hysteretic mode such as the one described in the examples of the embodiments), the LEDs can be dimmed only with a second switch S2 which has a very low impedance, the losses are very low.

In addition, the second switch S2 can be controlled so that it can control the current with an available highly resistive voltage measurement path or a similar available highly resistive circuit arrangement taking charge of the LED.

When the first switch is not clocked, for example as shown in FIG. 6, no current should be flowing through the LEDs. However, because of the present voltage distributor R40/R47, a very small current can still flow through the LED.

In this case, the second switch S2 can be closed with the desired deactivation of the LEDs (for example when no light should be emitted), so that the current flowing through the LEDs is interrupted or prevented from flowing.

The second switch S2 can be controlled at least always in connection with a low frequency PWM packet in order to bridge or deactivate the LEDs (during the last discharge edge, which is to say at the end of a PWM pulse packet).

An interruption of the current flowing through the LEDs can be realized with an arrangement of the second switch S2 in series with the LEDs.

The example of FIG. 6 (and naturally as well as the other examples) can obviously also be further developed when several operating circuits according to FIG. 6 are available. The control circuits IC or control units SR of the individual operating circuits are controlled by a common microcontroller. The individual operating circuits can be controlled for example by LED strings which have different wavelengths or colors. The control of the microcontroller can be realized via an interface (wireless or with fixed connections). The control signals can be in this case transmitted in order to adjust the brightness or color, or also status information, through the interface.

The invention claimed is:

1. An operating circuit for at least one LED, which is supplied with direct current voltage or rectified alternating current voltage, and which provides a supply voltage for the at least one LED by a coil (L1) and a first switch (S1) that is clocked by a control/regulation unit (SR), where during the activated state of the first switch (S1), energy is temporarily stored in the coil (L1), which is discharged when the first switch (S1) is turned off through a free wheeling diode (D1) and through at least one LED, wherein a capacitor (C1) is provided, which is arranged in parallel to at least one LED, and which maintains the current through the LED during a demagnetization phase of the coil (L1), a first sensor unit (SE1) is provided, which generates a sensor signal (SES1) which is dependent on the current flowing through the first switch (S1), and with a second sensor unit (S2), which detects that the demagnetization of the coil (L1) has been reached and generates a sensor signal (SES2), the sensor signals (SES1, SES2) are supplied to and processed by a control/regulation unit (SR) at a point in time when the first switch (S1) is turned on again, when the coil (L1) is demagnetized and thereby the free wheeling diode (D1) is blocking.

2. The operating circuit according to claim 1, wherein the sensor unit (SR) uses a combination of the signal (SES1) of the first sensor unit (SE1) and a signal (SES2) of the second sensor unit (SE2) for determining the point in time for turning the first switch (S1) on and off.

3. The operating circuit according to claim 2, wherein the control/regulation unit (SR) of the first switch (S1) is turned off when the current flowing through the first switch (S1) exceeds a maximum reference value.

4. The operating circuit according to claim 1, wherein the first sensor unit (SE1) is a measurement resistor (shunt, RS).

5. The operating circuit according to claim 1, wherein the second sensor unit (SE2) comprises a secondary winding (L2) which is inductively coupled with the coil (L1).

6. The operating circuit according to claim 1, wherein the second sensor unit (SE2) is a Hall sensor.

7. The operating circuit according to claim 1, wherein the second sensor unit (SE2) determines whether demagnetization of the coil (L1) has been reached, as the unit monitors the voltage at the node (Ux) between the first switch (S1) and the coil (L1).

8. The operating circuit according to claim 7, wherein the detection of the voltage is realized by a resistive voltage distributor (R1/R2), a capacitive voltage distributor, or a combined voltage distributor comprising a resistance and a capacitance.

9. The operating circuit according to claim 1, further comprising a control circuit IC, which is provided with an input for determining whether the demagnetization of the coil (L1) has been reached and controls a first switch (S1).

10. The operating circuit according to claim 9, further comprising a microcontroller, which activates and/or deactivates by applying a voltage to an input of the control circuit IC this control circuit, and presets a reference voltage for the control circuit IC at another input.

11. The operating circuit according to claim 1, wherein the operating circuit can be controlled by a second switch (S2), which is arranged in parallel to the capacitor (C1) and to the LEDs and is independent of the first switch (S1).

12. The operating circuit according to claim 11, wherein the second switch is closed in order to accelerate a discharging operation of the capacitor (C1).

13. A method for operating at least one LED by a switching regulator circuit, which is supplied with direct current voltage or rectified alternating current voltage and which provides a supply voltage for at least one LED by a coil (L1) and a first switch (S1) that is clocked by a control/regulation unit (SR), where during the activated state of the first switch (S1), energy is temporarily stored in the coil (L1), which is discharged when the first switch (S1) is turned off through a free wheeling diode (D1) and through at least one LED, where a capacitor (C1) is provided, which is arranged in parallel to at least one LED, and which maintains the current through the LED during the phase of the demagnetization of the coil (L1), the method comprising:

providing a first sensor unit (SE1), which generates a sensor signal (SES1) that is dependent on the current flowing through the first switch (S1), and a second sensor unit (SE2), which detects demagnetization of the coil (L1), turning the first switch (S1) on again, via the control/regulation unit (SR), at a point in time when the coil (L1) is demagnetized and thereby the free wheeling diode (D1) is blocking.

14. The method for operating at least one LED according to claim 13 wherein the control/regulation unit (SR) of the first switch (S1) is turned off when the current flowing through the first switch (S1) exceeds a maximum reference value.

* * * * *